US006501425B1

(12) United States Patent
Nagumo et al.

(10) Patent No.: US 6,501,425 B1
(45) Date of Patent: Dec. 31, 2002

(54) SURFACE-MOUNTED TYPE ANTENNA AND COMMUNICATION DEVICE INCLUDING THE SAME

(75) Inventors: Shoji Nagumo, Kawasaki (JP); Nobuhito Tsubaki, Shiga-ken (JP); Takashi Ishihara, Sagamihara (JP); Kazunari Kawahata, Machida (JP)

(73) Assignee: Murrata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/807,642

(22) PCT Filed: Sep. 8, 2000

(86) PCT No.: PCT/JP00/06158

§ 371 (c)(1),
(2), (4) Date: Apr. 16, 2001

(87) PCT Pub. No.: WO01/18909

PCT Pub. Date: Mar. 15, 2001

(30) Foreign Application Priority Data

Sep. 9, 1999 (JP) ..... 11/255551

(51) Int. Cl.[7] ..... H01Q 1/38
(52) U.S. Cl. ..... 343/700 MS; 343/702
(58) Field of Search ..... 343/700 MS, 702, 343/895, 904, 893, 785; 333/202 DB, 204, 206, 222; H01Q 1/38

(56) References Cited

U.S. PATENT DOCUMENTS 5,351,063 A * 9/1994 Kim et al. ..... 343/895
5,684,492 A * 11/1997 Kagoshima et al. . 343/700 MS
5,696,517 A * 12/1997 Hawahata et al. ... 343/700 MS
5,748,149 A * 5/1998 Kawahata ..... 343/700 MS
5,781,158 A * 7/1998 Ko et al. ..... 343/700 MS
5,854,606 A * 12/1998 Kawahata et al. ..... 343/702
5,909,198 A * 6/1999 Mandai et al. ..... 343/895
6,100,849 A * 8/2000 Tsubaki et al. ..... 343/702
6,300,909 B1 * 10/2001 Tsubaki et al. ..... 343/700 MS
6,313,797 B1 * 11/2001 Kurita et al. ..... 343/700 MS
6,323,811 B1 * 11/2001 Tsubaki et al. ..... 343/700 MS

FOREIGN PATENT DOCUMENTS

| | | |
|---|---|---|
| JP | 7-131234 | 5/1995 |
| JP | 9-260934 | 10/1997 |
| JP | 11-004113 | 1/1999 |
| JP | 11-127014 | 5/1999 |
| JP | 12-278028 | 10/2000 |

* cited by examiner

*Primary Examiner*—Don Wong
*Assistant Examiner*—Trinh Vo Dinh
(74) *Attorney, Agent, or Firm*—Keating & Bennett, LLP

(57) ABSTRACT

Power non-supplied side radiation electrode 3 and power supplied side radiation electrode 4 are formed on the surface of a dielectric substrate 2 with a space therebetween. A permittivity adjusting material portion 8 is provided in the space S which is situated between the power non-supplied side radiation electrode 3 and the power supplied side radiation electrode 4, and in which a capacity occurs. The permittivity adjusting material portion 8 has a lower permittivity than that of the dielectric substrate 2, which causes the permittivity between the power non-supplied side radiation electrode 3 and the power supplied side radiation electrode 4 to be lower than that of dielectric substrate 2, and weaken the capacitive coupling between the power non-supplied side radiation electrode 3 and the power supplied side radiation electrode 4.

18 Claims, 10 Drawing Sheets

SURFACE-MOUNTED TYPE ANTENNA AND COMMUNICATION DEVICE INCLUDING THE SAME

TECHNICAL FIELD

The present invention relates to a surface-mounted type antenna to be mounted on circuit boards and the like incorporated in communication devices, and further relates to a communication device including the same.

BACKGROUND ART

In communication devices such as portable telephones, there are cases where a chip-shaped surface-mounted type antenna is mounted on the circuit board incorporated therein. There are plenty of varieties in the surface-mounted type antennas. One of them is a plural-resonance surface-mounted type antenna.

This plural-resonance surface-mounted type antenna has a dielectric substrate constituted of dielectric body such as a ceramic or a resin, and has two radiation electrodes disposed on the surface thereof, with a space between the radiation electrodes. The resonance frequencies of the two radiation electrodes are set so as to deviate from each other so that the frequency bands of transmitting and receiving waves of these two radiation electrodes partially overlap each other, as indicated by frequencies f1 and f2 in FIG. 10. By resonating the two radiation electrodes which thus slightly differ in the resonance frequency from each other, plural-resonance conditions in frequency characteristics as indicated by the solid line in FIG. 10 is created, whereby widening of the frequency bands of transmitting and receiving waves of the surface-mounted type antenna is realized.

With a view to miniaturizing the surface-mounted type antenna, however, there is a tendency to increase the permittivity of the dielectric substrate and to narrow the gap between the two radiation electrodes. As a result, the capacity occurring between the two radiation electrodes increases, and the capacitive coupling therebetween strengthens, which results in a mutual interference of the resonances generated between the two radiation electrodes. This raises a problem that one of the two radiation electrodes hardly resonates and that a satisfactory plural-resonance conditions thereby cannot be achieved.

Also, when aiming at thinning the surface-mounted type antenna, the distances between the two radiation electrodes and the ground are reduced, and thereby the capacities (fringing capacities) between the radiation electrodes and the ground increase. When the degree of increase in these fringing capacities are remarkable so that the fringing capacities become significantly larger than the capacity between the two radiation electrodes, the problem of being unable of achieving satisfactory plural-resonance conditions occurs, just as in the case described above.

DISCLOSURE OF INVENTION

The present invention has been made in view of solving the above-described problems, and aims to present a surface-mounted type antenna of which the miniaturization and thinning has been realized, and which allows superior plural-resonance conditions to be achieved by adjusting the strength of the capacitive coupling between the two radiation electrodes, and aims further to present a communication device provided therewith.

In order to achieve the above-described objects, the present invention has the following constructions as means for solving the above-described problems. A surface-mounted type antenna in accordance with a first invention comprises a dielectric substrate, a first radiation electrode formed on the dielectric substrate, and a second radiation electrode disposed on the dielectric substrate at a predetermined distance from the first radiation electrode. In this surface-mounted type antenna, there is provided capacitive-coupling adjusting means which makes the permittivity between the first radiation electrode and the second radiation electrode differ from that of the dielectric body, and which varies the strength of the capacitive coupling between the first radiation electrode and the second radiation electrode.

A surface-mounted type antenna in accordance with a second invention has the construction of the first invention, and is characterized in that the capacitive-coupling adjusting means thereof is constituted of a recess or a groove in which a capacity occurs and which is formed between the first radiation electrode and the second radiation electrode, in the surface of the dielectric substrate.

A surface-mounted type antenna in accordance with a third invention has the construction of the first invention, and is characterized in that a permittivity adjusting material portion which has a different permittivity from that of the dielectric substrate is interposed between the first radiation electrode and the second radiation electrode and that this permittivity adjusting material portion constitutes capacitive-coupling adjusting means.

A surface-mounted type antenna in accordance with a fourth invention has the construction of the first invention, and is characterized in that the capacitive-coupling adjusting means is constituted of areas of the first radiation electrode and the second radiation electrode, the area being a hollow portion situated inside the dielectric substrate.

A surface-mounted type antenna in accordance with a fifth invention comprises a dielectric substrate, a first radiation electrode formed on the surface of the dielectric substrate, and a second radiation electrode disposed on the surface of the dielectric substrate at a predetermined distance from the first radiation electrode. This surface-mounted type antenna is characterized in that the dielectric substrate is formed by bonding a first dielectric substrate and a second dielectric substrate which has a different permittivity from that of the first dielectric substrate, that the first radiation electrode is formed on the first dielectric substrate while the second radiation electrode is formed on the second dielectric substrate, and that the bonded portion between the first dielectric substrate and the second dielectric substrate is disposed in the space which is situated between the first radiation electrode and the second radiation electrode and in which a capacity occurs.

A communication device in a sixth invention is characterized in that it is provided with a surface-mounted type antenna which has a construction of any one of the first through fifth inventions.

In the invention having the above-described features, for example, the capacitive-coupling adjusting means makes the permittivity between the first radiation electrode and the second radiation electrode differ from that of the dielectric body. As a result, the strength of the capacitive coupling in the space which is situated between the first radiation electrode and the second radiation electrode and in which a capacity occurs, varies in the "stronger" direction or in the "weaker" direction according to the permittivity between the first radiation electrode and the second radiation electrode, than the case where the permittivity between the first radiation electrode and the second radiation electrode is the permittivity of the dielectric substrate. In the present invention, since the strength of the capacitive coupling in the space which is situated between the first radiation electrode and the second radiation electrode and in which a capacity occurs, can be adjusted, it is possible to inhibit the mutual interference of the resonances of the first radiation electrode and the second radiation electrode, and to thereby improve antenna characteristics, while achieving the miniaturization and thinning of the surface-mounted type antenna.

BEST MODE FOR CARRYING OUT THE INVENTION

Hereinafter, the embodiments in accordance with the present invention will be described with reference to the drawings.

Figure 1:
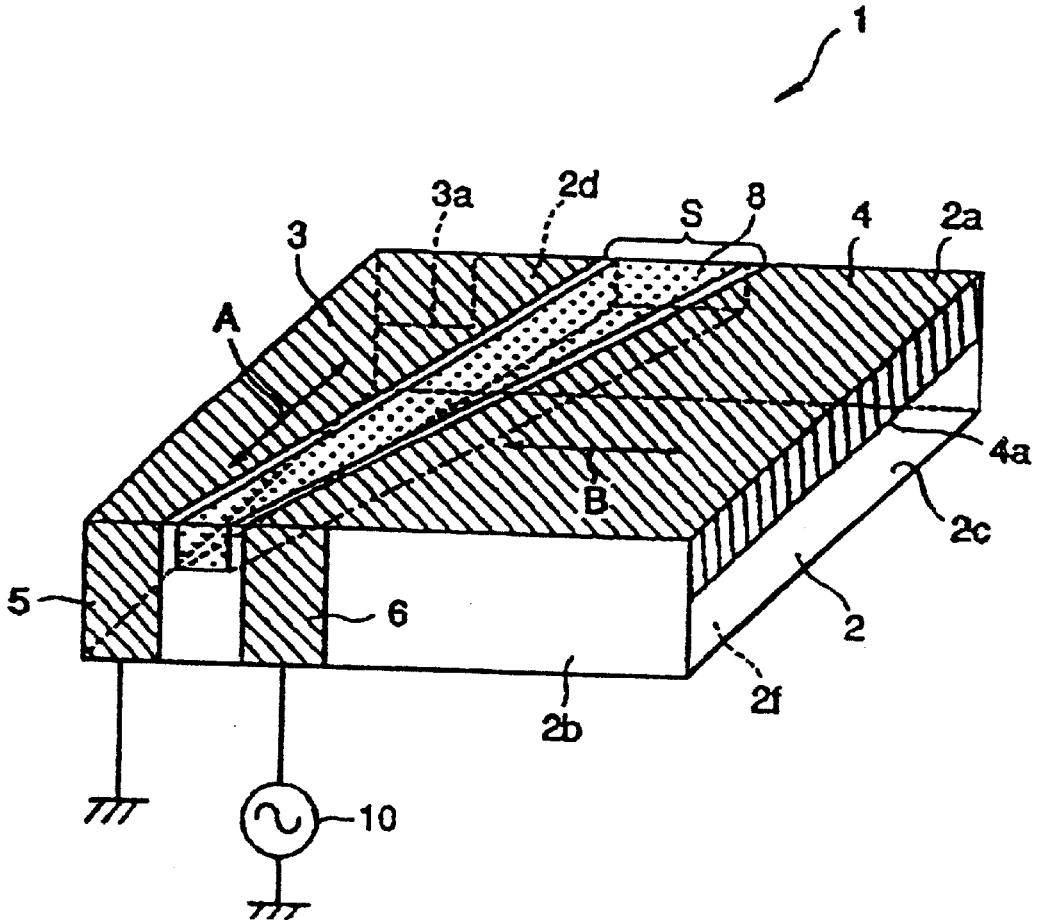
FIG. 1 is a model view showing a surface-mounted type antenna in accordance with a first embodiment of the present invention.

FIG. 1 shows a schematic perspective view showing a surface-mounted type antenna in accordance with a first embodiment. The surface-mounted type antenna 1 shown in FIG. 1 has a dielectric substrate 2, and on the top surface 2*a* of the dielectric substrate 2, a power non-supplied side radiation electrode 3 which is a first radiating electrode, and a power supplied side radiation electrode 4 which is a second radiating electrode are formed with a space therebetween. In this first embodiment, the space S between the power non-supplied side radiation electrode 3 and the power supplied side radiation electrode 4 is formed so that the longitudinal sides thereof tilt with respect to each side of the top surface 2*a* of the dielectric substrate 2 (for example, at an angle of 45 degrees).

On a side surface 2*b* of the dielectric substrate 2, a ground electrode 5 connected to the power non-supplied side radiation electrode 3, and a power supply electrode 6 connected to the power supply radiation side radiation electrode 4 are each linearly formed from the top surface side to the bottom surface side. The power supply radiation side radiation electrode 4 extends from the top surface 2*a* and forms the open end 4*a* thereof on a side surface 2*c* of the dielectric substrate 2, while the power non-supply radiation side radiation electrode 3 extends from the top surface 2*a* and forms the open end 3*a* thereof on a side surface 2*d*.

The space S is formed so as to gradually widen from the side surface 2*b*, where the ground electrode 5 and the power supply electrode 6 are formed, toward the side surface 2*d* constituting an open end. The reason for this is as follows. The ground electrode 5 and the power supply electrode 6 are coupled in an electric field. Therefore, in order to effectively control the amount of the electric field coupling, it is effective to widen the space S on the open end, where a strong electric field exists, that is, the space S on the side surface 2*d* side.

A permittivity adjusting material portion 8 which is the most characteristic capacitive-coupling adjusting means of the first embodiment is provided in the space S between the power non-supplied side radiation electrode 3 and the power supplied side radiation electrode 4. The purpose of providing the permittivity adjusting material portion 8 shown in the first embodiment is to weaken the capacitive coupling between the power non-supplied side radiation electrode 3 and the power supplied side radiation electrode 4. The permittivity adjusting material portion 8 has a lower permittivity than that of the dielectric substrate 2. In the example shown in FIG. 1, the permittivity adjusting material portion 8 is embedded only in the upper side of the space S between the power non-supplied side radiation electrode 3 and the power supplied side radiation electrode 4, in the dielectric substrate 2 (that is, only in the area chiefly concerned to the capacity between the power non-supplied side radiation electrode 3 and the power supplied side radiation electrode 4).

The surface-mounted type antenna in according with the first embodiment has the features as described above. Such a surface-mounted type antenna 1 is mounted onto the circuit board incorporated in a communication device such as portable telephone or the like, in such a manner in which the bottom 2*f* of the dielectric substrate 2 is mounted on the circuit board side. The circuit board has a power supply circuit 10 formed thereon. By mounting the surface-mounted type antenna 1 onto the circuit board, the power supply electrode 6 of the surface-mounted type antenna 1 is connected to the power supply circuit 10.

When a power is supplied from the power supply circuit 10 to the power supply electrode 6, the power is directly supplied from the power supply electrode 6 to the power supplied side radiation electrode 4, and the power is transmitted by the power supply electrode 6 to the power non-supplied side radiation electrode 3 by virtue of electromagnetic coupling, whereby the power non-supplied side radiation electrode 3 and the power supplied side radiation electrode 4 resonate and perform the function of an antenna.

As described above, in this first embodiment, the longitudinal sides of the space S between the power non-supplied side radiation electrode 3 and the power supplied side radiation electrode 4 tilt with respect to each side of the top surface 2*a* of the dielectric substrate 2, and the ground electrode 5 and the power supply electrode 6 are disposed adjacent to each other, as well as the open end 3*a* of the power non-supplied side radiation electrode 3 and the open end 4*a* of the power supplied side radiation electrode 4 are formed on the different side surfaces from each other, of the dielectric substrate 2. By these features, as shown in FIG. 1, the resonance direction A of the power non-supplied side radiation electrode 3 and the resonance direction B of the power supplied side radiation electrode 4 intersect each other substantially at right angles. This allows the mutual interference of the resonances of the power non-supplied side radiation electrode 3 and the power supplied side radiation electrode 4 to be suppressed, and enables superior antenna characteristics to be achieved, without widening the space S between the power non-supplied side radiation electrode 3 and the power supplied side radiation electrode 4.

Thus, the mutual interference of the resonances of the power non-supplied side radiation electrode 3 and the power supplied side radiation electrode 4 can be substantially inhibited, by arranging the resonance direction A of the power non-supplied side radiation electrode 3 and the resonance direction B of the power supplied side radiation electrode 4 so as to intersect each other substantially at right angles. However, when the dielectric substrate 2 is formed of a material having a high permittivity or is thinned for the purpose of miniaturization, the above-described arrangement cannot achieve by itself the capacity between the power non-supplied side radiation electrode 3 and the power supplied side radiation electrode 4, the capacity being commensurate with the capacity (fringing capacity) between the power non-supplied side radiation electrode 3 and the ground or the capacity (fringing capacity) between the power supplied side radiation electrode 4 and the ground. This results in that a mutual interference of the resonances between the power non-supplied side radiation electrode 3 and the power supplied side radiation electrode 4 cannot be completely inhibited.

In contrast, when the capacity between the power non-supplied side radiation electrode 3 and the power supplied side radiation electrode 4 is larger than the above-described fringing capacity, the permittivity adjusting material portion 8 which has a lower permittivity than that of the dielectric substrate 2 is interposed between the power non-supplied side radiation electrode 3 and the power supplied side radiation electrode 4, in this first embodiment, as described above, so that the capacity occurring between the power non-supplied side radiation electrode 3 and the power supplied side radiation electrode 4 can be made smaller than the case where the entire area between the power non-supplied side radiation electrode 3 and the power supplied side radiation electrode 4 is the dielectric substrate 2. This allows the capacitive coupling between the power non-supplied side radiation electrode 3 and the power supplied side radiation electrode 4 to be significantly weakened.

In this first embodiment, therefore, by providing both of the arrangement for making the resonance directions of the power non-supplied side radiation electrode 3 and power supplied side radiation electrode 4 intersect each other substantially at right angles, and the arrangement for weakening the capacitive coupling between the power non-supplied side radiation electrode 3 and the power supplied side radiation electrode 4, it is possible to inhibit substantially surely the mutual interference of the resonances of the power non-supplied side radiation electrode 3 and the power supplied side radiation electrode 4, without taking measures such as a reduction of the permittivity of the dielectric substrate 2, or widening of the space S between the power non-supplied side radiation electrode 3 and the power supplied side radiation electrode 4, from the viewpoint of the miniaturization of the dielectric substrate 2. This allows superior plural-resonance conditions to be stably achieved and enables antenna characteristics to be improved.

Also, since the space S is wider on the side surface 2*d* side constituting an open end, the control of the amount of the capacitive coupling between the power non-supplied side radiation electrode 3 and the power supplied side radiation electrode 4 can be effectively performed, in conjunction with the adjustment of the capacitive coupling by the permittivity adjusting material portion 8.

In this first embodiment, since superior plural-resonance conditions are thus stably achieved, excellent effects are produced which allow a surface-mounted type antenna 1 which is small and low-profile and which has high-reliability antenna characteristics to be provided.

Figure 2:
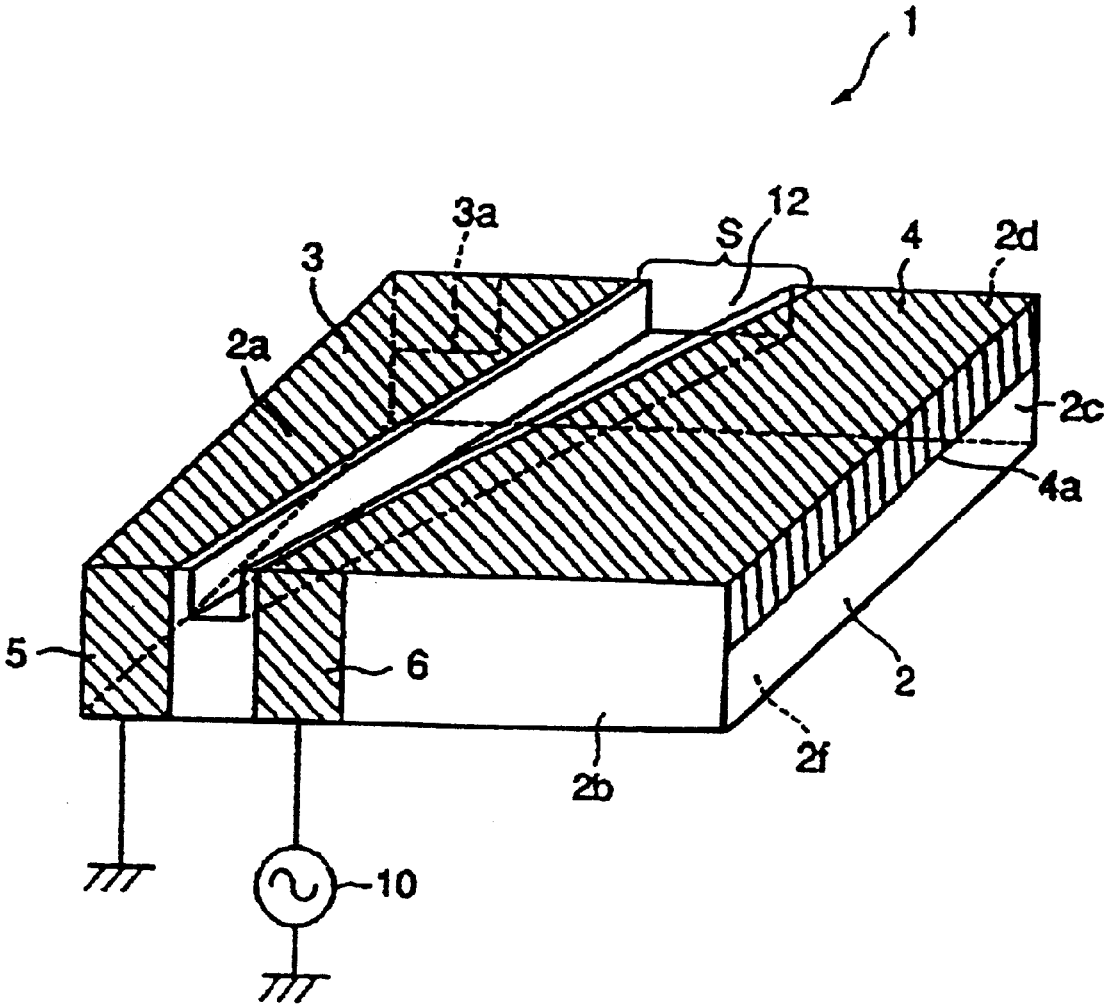
FIG. 2 is a model view showing a surface-mounted type antenna in accordance with a second embodiment of the present invention.

Next, a second embodiment of the present invention will be described. This second embodiment characteristically differs from the above-described first embodiment in that, as shown in FIG. 2, there is provided a groove 12 which is capacity coupling means, instead of the permittivity adjusting material portion 8 provided between the power non-supplied side radiation electrode 3 and the power supplied side radiation electrode 4. Other features are the same as those of the first embodiment. In this second embodiment, the same components as those of the first embodiment have been given the same reference numerals, and repeated descriptions of the components in common therebetween will be omitted.

The surface-mounted type antenna in accordance with the second embodiment is also provided with an arrangement for weakening the capacitive coupling between the power non-supplied side radiation electrode 3 and the power supplied side radiation electrode 4, as in the case of the first embodiment. Specifically, the groove 12 which characterizes this second embodiment is provide along the longitudinal sides of the space S between the power non-supplied side radiation electrode 3 and the power supplied side radiation electrode 4, and the magnitude of the groove 12 is one enough to reduce the permittivity between the power non-supplied side radiation electrode 3 and the power supplied side radiation electrode 4 to a small value such as to inhibit the mutual interference of the resonances of the power non-supplied side radiation electrode 3 and the power supplied side radiation electrode 4.

In accordance with the second embodiment, the power non-supplied side radiation electrode 3 and the power supplied side radiation electrode 4 are formed so as to intersect each other substantially at right angles, as in the case of the first embodiment. In addition, the groove 12 is formed between the power non-supplied side radiation electrode 3 and the power supplied side radiation electrode 4, whereby the permittivity between the power non-supplied side radiation electrode 3 and the power supplied side radiation electrode 4 is made lower than that of the dielectric substrate 2, and thereby the capacitive coupling between the power non-supplied side radiation electrode 3 and the power supplied side radiation electrode 4 is weakened. By such features, in this second embodiment also, it is possible to reliably inhibit the mutual interference of the resonances of the power non-supplied side radiation electrode 3 and the power supplied side radiation electrode 4, and to stably achieve superior plural-resonance conditions, as is the case with the first embodiment. This can produce superior effects which allow a surface-mounted type antenna 1 which is small and low-profile and which has high-reliability antenna characteristics to be provided.

Figure 3:
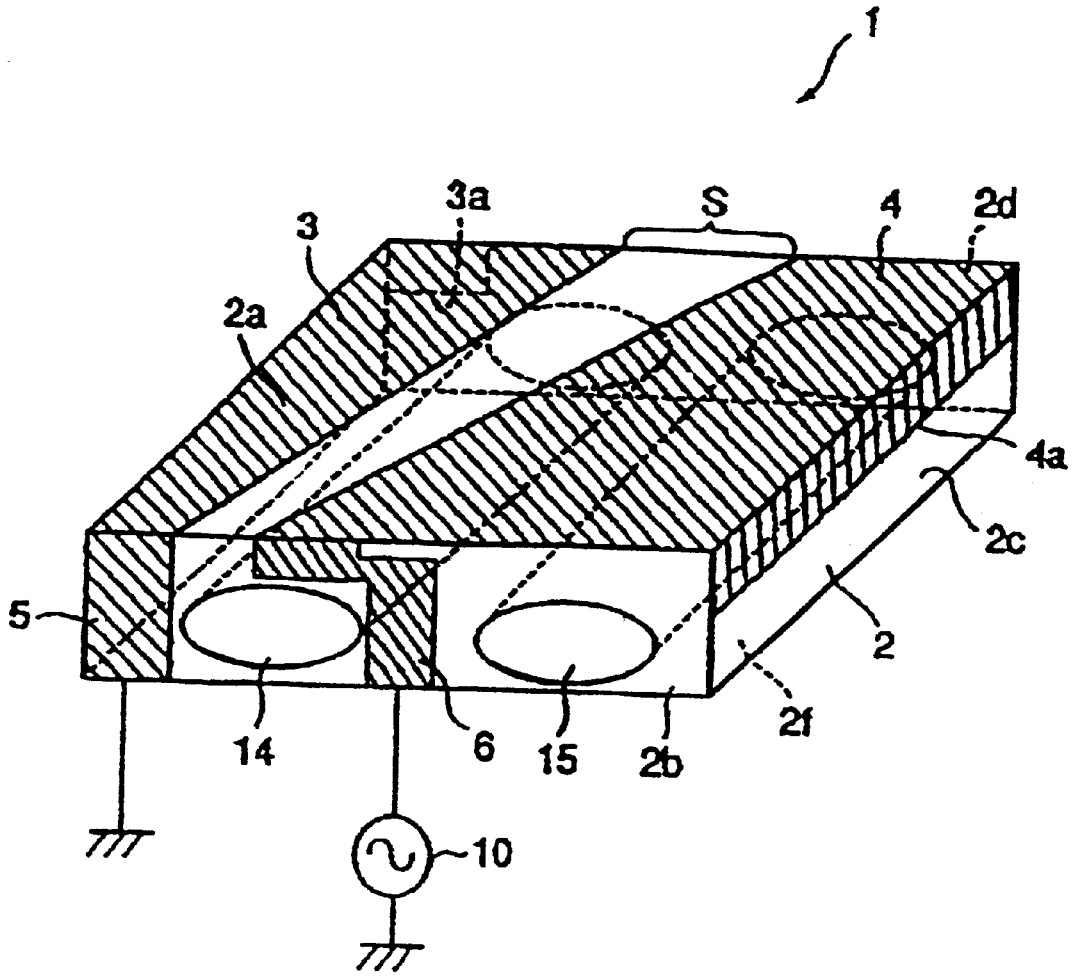
FIG. 3 is a model view showing a surface-mounted type antenna in accordance with a third embodiment of the present invention.

Next a third embodiment of the present invention will be described. This third embodiment is characterized in that, as shown in FIG. 3, hollow portions 14 and 15 as capacitive-coupling adjusting means are provided within the dielectric substrate 2. Other features are the same as those of the above-described embodiments. In this third embodiment, the same components as those of the above-described embodiments have been given the same reference numerals, and repeated descriptions of components in common therebetween will be omitted.

As illustrated in FIG. 3, in this third embodiment, the hollow portion 14 is located in the area of the power non-supplied side radiation electrode 3, within the dielectric substrate 2, while the hollow portion 15 is provided together with the hollow portion 14 at a distance therefrom.

In accordance with the third embodiment, since the hollow portion 14 is formed in the area of the power non-supplied side radiation electrode 3, within the dielectric substrate 2, the hollow portion 14 allows the capacity between the power non-supplied side radiation electrode 3 and the ground to be reduced. Also, since the hollow portion 15 is formed in the area of the power supplied side radiation electrode 4, within the dielectric substrate 2, the hollow portion 15 allows the capacity between the power supplied side radiation electrode 4 and the ground to be reduced.

Specifically, in the third embodiment, since each of the fringing capacities between the radiation electrodes 3 and 4 and the ground can be easily varied so as to be commensurate with the capacity between the power non-supplied side radiation electrode 3 and the power supplied side radiation electrode 4, it is possible to adjust the capacity between the power non-supplied side radiation electrode 3 and the power supplied side radiation electrode 4 and the above-described fringing capacity so as to have an proper relationship of being commensurate with each other. This inhibits substantially surely the mutual interference of the resonances of the power non-supplied side radiation electrode 3 and the power supplied side radiation electrode 4, and allows superior plural-resonance conditions to be stably achieved, as in the cases of the above-described embodiments. Thereby superior effects can be produced which allow a surface-mounted type antenna 1 which is small and low-profile and which has high-reliability antenna characteristics to be attained.

As describe above, in the third embodiment, since the hollow portion 14 is located adjacent to the open end 3*a* of the power non-supplied side radiation electrode 3, and the hollow portion 15 is formed adjacent to the open end 4*a* of the power supplied side radiation electrode 4, it is possible to reduce the permittivity between the power non-supplied side radiation electrode 3 and the ground, and that between the power supplied side radiation electrode 4 and the ground, and is thereby possible to relieve the electric field concentration between the power non-supplied side radiation electrode 3 and the ground and that between the power supplied side radiation electrode 4 and the ground.

This effect coupled with the suppressing effect with respect to the mutual interference of the resonances between the power non-supplied side radiation electrode 3 and the power supplied side radiation electrode 4, can promote widening of the band width of the surface-mounted type antenna 1 and an increase in the gain thereof.

Next, a fourth embodiment of the present invention will be described. In the descriptions of this fourth embodiment, the same components as those of the above-described embodiments have been given the same reference numerals, and repeated descriptions of components in common therebetween will be omitted.

Figure 4A:
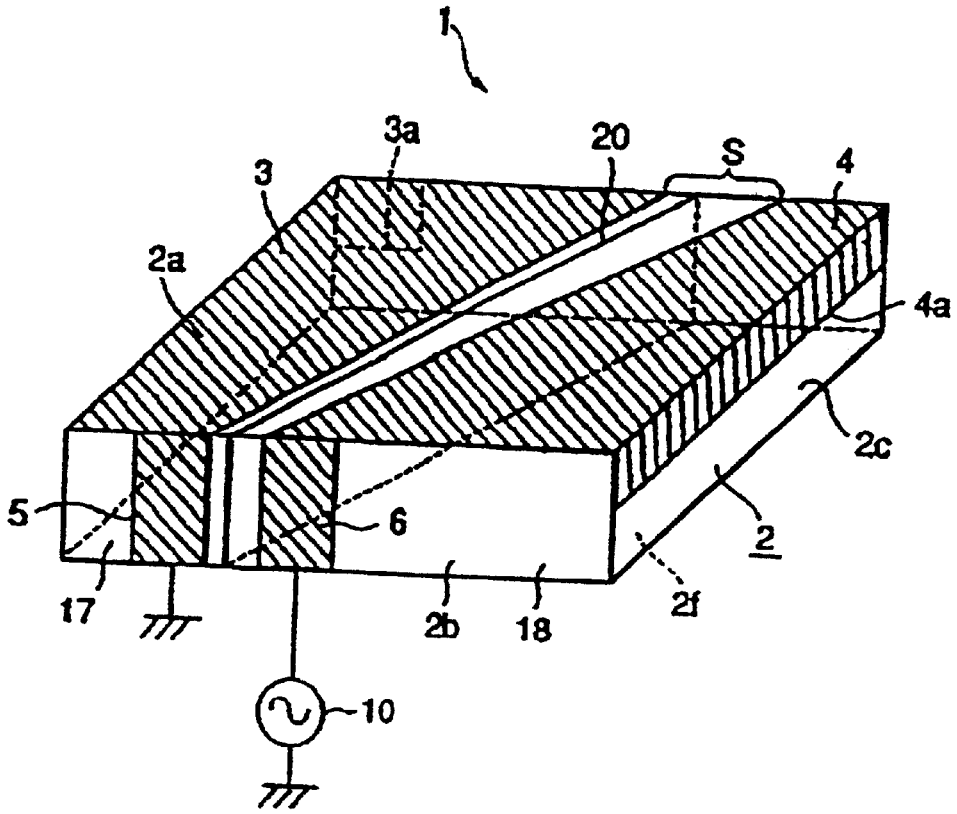
FIGS. 4A and 4B are model views showing a surface-mounted type antenna in accordance with a fourth embodiment of the present invention.
Figure 4B:
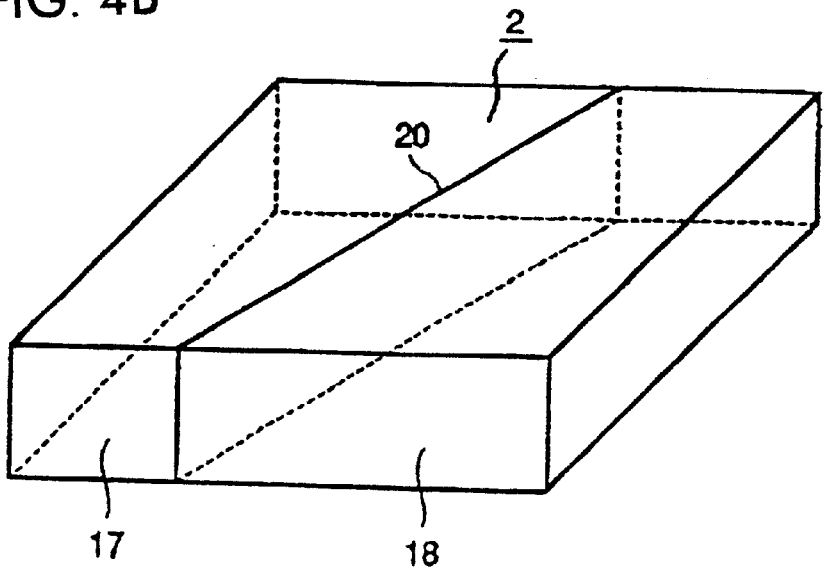

The fourth embodiment is characterized in that, as is the cases with the above-described embodiments, there is provided an arrangement for weakening the capacitive coupling between the power non-supplied side radiation electrode 3 and the power supplied side radiation electrode 4. Specifically, as illustrated in FIGS. 4A and 4B, the dielectric substrate 2 is formed by bonding first and second dielectric substrates 17 and 18 which have different permittivities from each other, and the bonded portion 20 between the first dielectric substrate 17 and the second dielectric substrate 18 is disposed in the space S between the power non-supplied side radiation electrode 3 and the power supplied side radiation electrode 4. Other features are substantially the same as those of the above-described embodiments. In this fourth embodiment, the same components as those of the above-described embodiments have been given the same reference numerals, and repeated descriptions of components in common therebetween will be omitted.

In this fourth embodiment, the second dielectric substrate 18 has a lower permittivity than that of the first dielectric substrate 17, and the first dielectric substrate 17 and the second dielectric substrate 18 are bonded by, for example, a ceramic adhesive. As illustrated in FIG. 4A, a power non-supplied side radiation electrode 3 is formed on the surface of the first dielectric substrate 17, while a power supplied side radiation electrode 4 is formed on the surface of the second dielectric substrate 18. In other words, in the fourth embodiment, a dielectric substrate 2 is formed by bonding the first dielectric substrate 17 for forming the power non-supplied side radiation electrode 3 and the second dielectric substrate 18 for forming the power supplied side radiation electrode 4, the radiation electrodes 3 and 4 having different permittivities from each other.

As described above, in the fourth embodiment, the bonded portion 20 between the first dielectric substrate 17 and the second dielectric substrate 18 is disposed in the space S between the power non-supplied side radiation electrode 3 and the power supplied side radiation electrode 4. That is, the first and second dielectric substrates 17 and 18 which have different permittivities from each other, are disposed between the power non-supplied side radiation electrode 3 and the power supplied side radiation electrode 4. In such a case, the capacity between the power non-supplied side radiation electrode 3 and the power supplied side radiation electrode 4 is, of course, related to the occupation ratio between the first dielectric substrate 17 and the second dielectric substrate 18 in between the power non-supplied side radiation electrode 3 and the power supplied side radiation electrode 4, but it is primarily determined based on the permittivity of the dielectric substrate having the lower permittivity.

In consideration of this, the bonded portion 20 between the first dielectric substrate 17 and the second dielectric substrate 18 is disposed at the position which allows the capacitive coupling between the power non-supplied side radiation electrode 3 and the power supplied side radiation electrode 4 to be weakened, and which thereby enables the mutual interference of the resonances between the power non-supplied side radiation electrode 3 and the power supplied side radiation electrode 4 to be inhibited.

In accordance with the fourth embodiment, the dielectric substrate 2 is formed by bonding the first and second dielectric substrates 17 and 18 which have different permittivities from each other, and the bonded portion 20 between the first dielectric substrate 17 and the second dielectric substrate 18 is disposed in the space S between the power non-supplied side radiation electrode 3 and the power supplied side radiation electrode 4.

Providing this construction allows the capacity between the power non-supplied side radiation electrode 3 and the power supplied side radiation electrode 4 to be reduced, and enables the mutual interference of the resonances between the power non-supplied side radiation electrode 3 and the power supplied side radiation electrode 4 to be suppressed, with the result that superior plural-resonance conditions are stably achieved. This can produce superior effects which allow a surface-mounted type antenna 1 which is small and low-profile and which has high-reliability antenna characteristics to be provided.

Figure 5:
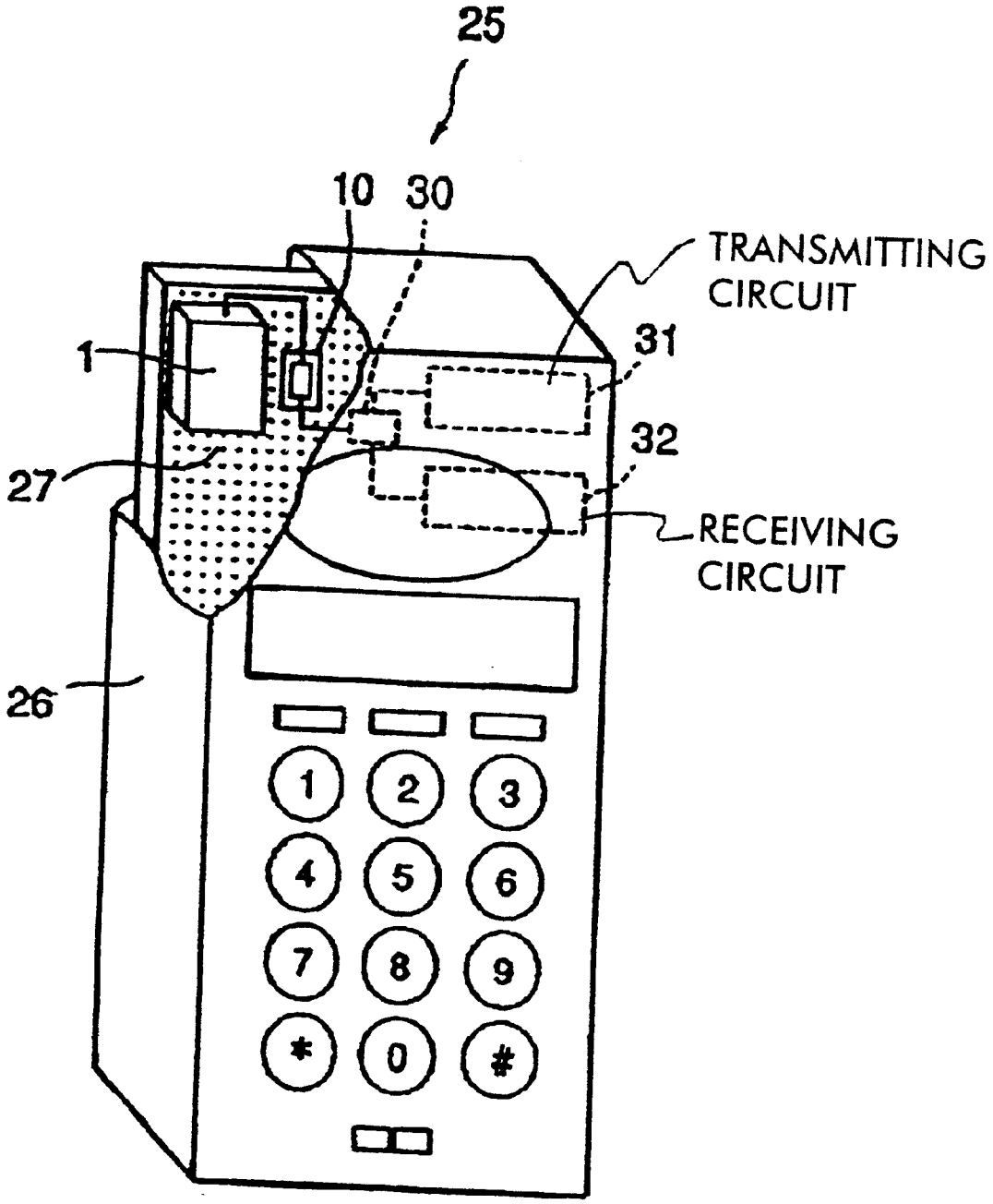
FIG. 5 is a model view showing a communication device in accordance with a fifth embodiment of the present invention.

Next, a fifth embodiment of the present invention will be described. In this fifth embodiment, an example of a communication device provided with one of the surface-mounted type antennas shown in the above-described embodiments is illustrated. FIG. 5 schematically illustrates an example of a portable telephone which is a communication device. The portable telephone 25 shown in FIG. 5 has a circuit board 27 provided in a case 26. A power supply circuit 10, a switching circuit 30, a transmitting circuit 31, and a receiving circuit 32 are formed on the circuit board 27. On such a circuit board 27, one of the surface-mounted type antennas 1 shown in the above-described embodiments, and this surface-mounted type antenna 1 is connected to the transmitting circuit 31, and the receiving circuit 32 via the power supply circuit 10 and the switching circuit 30.

In the portable telephone 25 shown in FIG. 5, the surface-mounted type antenna 1 performs the function of an antenna by receiving the supply of a power from the power supply circuit 10 thereto, as described above, and the transmission and reception of waves are smoothly performed by the switching action of the switching circuit 30.

In accordance with this fifth embodiment, since the portable telephone 25 is equipped with one of the surface-mounted type antennas 1 shown in the above-described embodiments, the miniaturization of the portable telephone can be easily achieved as a result of the size-reduction of the surface-mounted type antenna 1. Also, a portable telephone 25 having a high reliability of communication can be provided since it incorporates therein a surface-mounted type antenna 1 having superior antenna characteristics as described above.

Figure 6A:
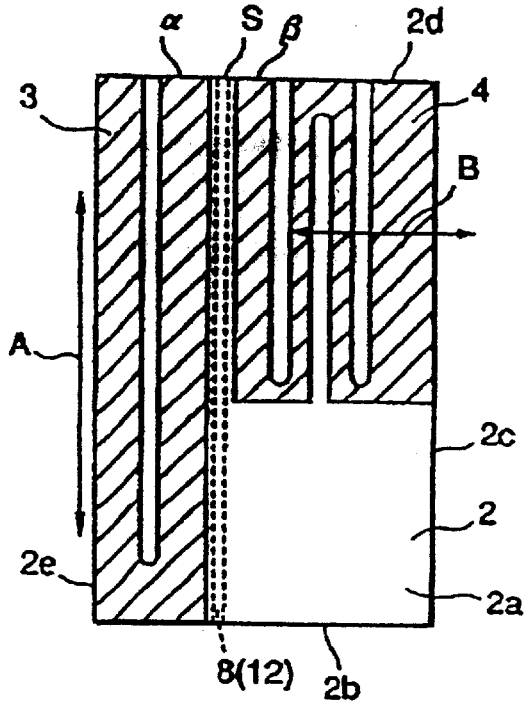
FIGS. 6A and 6B are explanatory views showing other shape examples of power supplied side radiation electrodes and power non-supplied side radiation electrodes in accordance with the present invention.
Figure 6B:
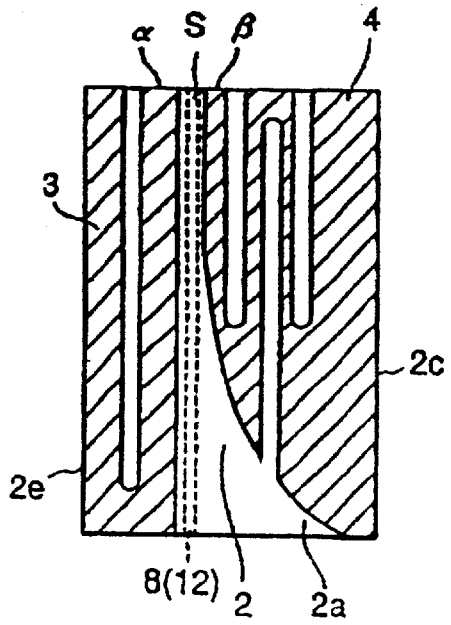

Meanwhile, the present invention is not limited to the above-described embodiments, but various embodiments can be adopted. Fore example, the shapes of the power non-supplied side radiation electrode 3 and the power supplied side radiation electrode 4 are not restricted to the shapes illustrated in the above-described embodiments, but various shapes can be used. For example, the shapes as shown in FIGS. 6(*a*), 6(*b*) and 7(*a*) can be employed. In the example shown in FIG. 6(*a*), the power non-supplied side radiation electrode 3 and the power supplied side radiation electrode 4 are formed into a meander-shape. The arrangement is such that a power is transmitted from an meander-shaped end portion α to the power non-supplied side radiation electrode 3, while a power is transmitted from an meander-shaped end portion β to the power supplied side radiation electrode 4. The open end of the power non-supplied side radiation electrode 3 is formed on a side surface 2*e* of the dielectric substrate 2, while the open end of the power supplied side radiation electrode 4 is formed on a side surface 2*c*. Forming the power non-supplied side radiation electrode 3 and the power supplied side radiation electrode 4 in this way, results in that the resonance direction A of the power non-supplied side radiation electrode 3 and the resonance direction B of the power supplied side radiation electrode 4 intersect each other at substantially at right angles. Consequently, as is the cases with the above-described embodiments, it is possible to substantially inhibit the mutual interference of the resonances of the power non-supplied side radiation electrode 3 and the power supplied side radiation electrode 4.

The example shown in FIG. 6(*b*) is the one wherein the electrode area on the open end side of the power supplied side radiation electrode 4 shown in FIG. 6(*a*) is enlarged, and wherein the electric field concentration on the open end side of the power supplied side radiation electrode 4 is thereby relieved in order to further improve the antenna characteristics.

Figure 7A:
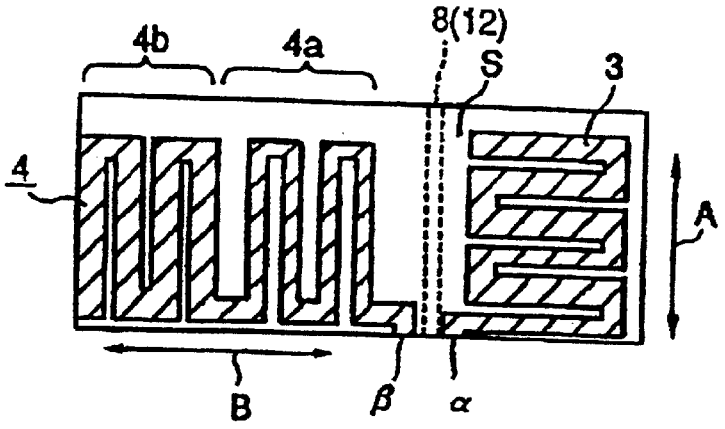
FIGS. 7A, 7B and 7C are another explanatory views showing still other shape examples of a power supplied side radiation electrode and a power non-supplied side radiation electrode in accordance with the present invention.
Figure 7B:
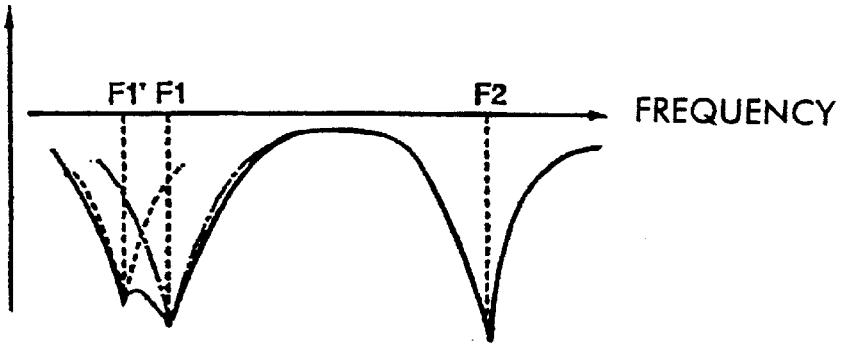
Figure 7C:
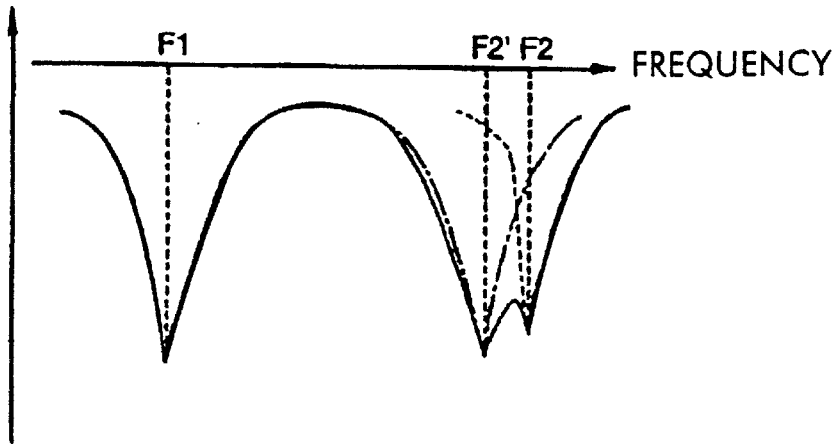

The examples illustrated in FIG. 7(*a*) are shape examples of the power non-supplied side radiation electrode 3 and the power supplied side radiation electrode 4 which allow the above-described plural resonance to be created in a dual-band surface-mounted type antenna 1 which is capable of transmitting and receiving waves in two different frequency bands from each other, as shown in the frequency characteristics in FIGS. 7(*b*) and 7(*c*). In this example illustrated in FIG. 7(*a*), the arrangement is such that the power non-supplied side radiation electrode 3 and the power supplied side radiation electrode 4 are each formed into meander-shapes, that an electrode is transmitted to each of the meander-shaped end portions α and β of the power non-supplied side radiation electrode 3 and the power supplied side radiation electrode 4, and that the resonance direction A of the power non-supplied side radiation electrode 3 and the resonance direction B of the power supplied side radiation electrode 4 intersect each other at substantially at right angles.

The power supplied side radiation electrode 4 is formed by continuously connecting a plurality of electrode portions 4*a* and 4*b* which differ in the meander pitch from each other, and is formed so as to have two resonance frequencies F1 and F2 such that the frequency bands of waves do not overlap each other, as illustrated in FIGS. 7(*b*) and 7(*c*).

The resonance frequency of the power non-supplied side radiation electrode 3 is set to a frequency in the vicinity of the resonance frequency F1 of the power supplied side radiation electrode 4, or to a frequency in the vicinity of the above-described resonance frequency F2 so as to have a plural-resonance relation with the resonance frequency of the power supplied side radiation electrode 4.

When the resonance frequency of the power non-supplied side radiation electrode 3 is set to a frequency in the vicinity of the resonance frequency F1 of the power supplied side radiation electrode 4, for example, to the frequency F1' shown in FIG. 7(*b*), a plural-resonance state is created at the resonance frequency F1, while, when the resonance frequency of the power non-supplied side radiation electrode 3 is set to a frequency in the vicinity of the resonance frequency F2 of the power supplied side radiation electrode 4, for example, to the frequency F2' shown in FIG. 7(*c*), a plural-resonance state is created at the resonance frequency F2.

When the construction which characterizes the above-described first and second embodiments is applied to the surface-mounted type antenna 1 wherein the power non-supplied side radiation electrode 3 and the power supplied side radiation electrode 4 are formed into the shapes shown in FIG. 6(*a*), 6(*b*), or 7(*a*), a permittivity adjusting material portion 8 or a groove 12 is provided, for example, as indicated by the dot lines in FIGS. 6(*a*), 6(*b*), or 7(*a*).

Figure 8A:
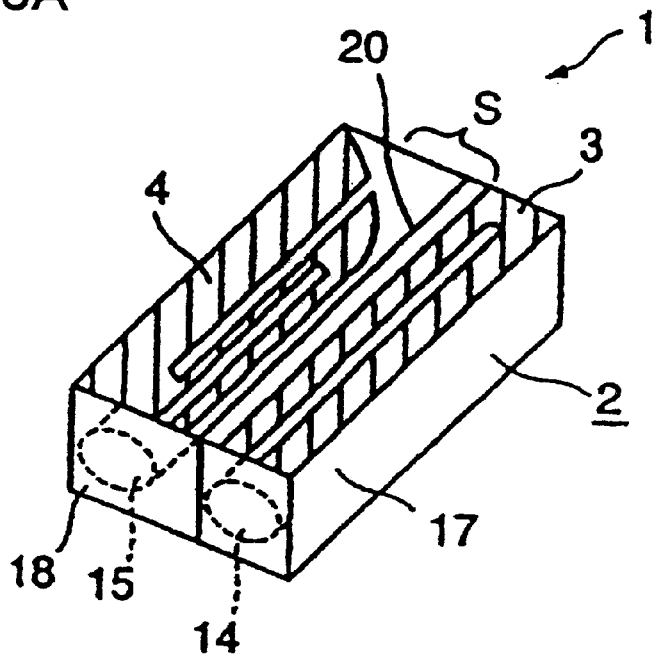
FIGS. 8A and 8B are explanatory views showing another embodiment of the present invention.
Figure 8B:
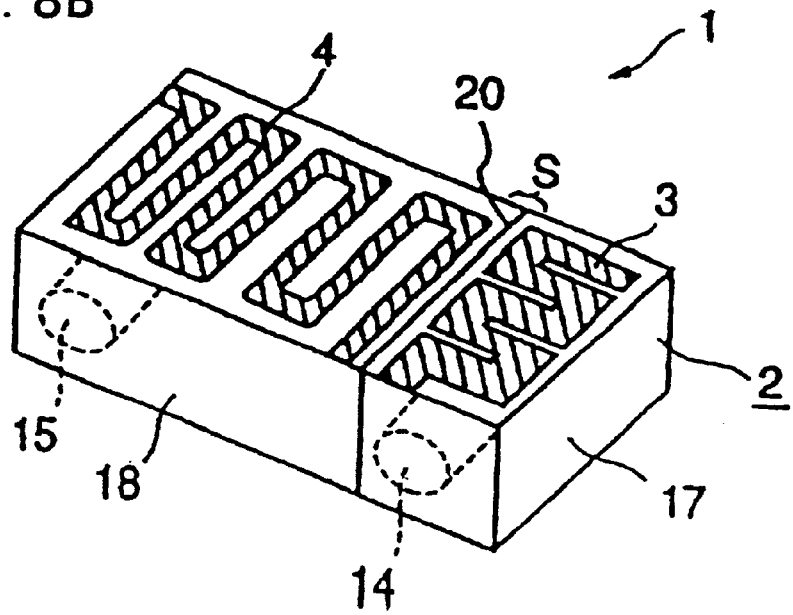

Furthermore, for example, when the construction which characterizes the above-described third embodiment is applied to the surface-mounted type antenna 1 which is formed into the shape shown in FIG. 6(*b*) or 7(*a*), hollow portions 14 and 15 are formed within the dielectric substrate 2, for example, as indicated by the dot lines in FIG. 8(*a*) or 8(*b*). Moreover, when the construction which characterizes the above-described fourth embodiment is applied, the dielectric substrate 2 is formed by bonding the first dielectric substrate 17 which is used for forming the power non-supplied side radiation electrode 3, and the second dielectric substrate 18 which has a lower permittivity and which is used for forming the power supplied side radiation electrode 4, for example, as shown in FIGS. 8(*a*) and 8(*b*).

In the above-described embodiments, the arrangement is such that a power is directly supplied from the power supply electrode 6 to the power supplied side radiation electrode 4, but it may be such that the power supplied side radiation electrode 4 and the power supply electrode 6 is non-connected to each other, and that a power is supplied from the power supply electrode 6 to the power supplied side radiation electrode 4 by means of capacitive coupling.

Figure 9:
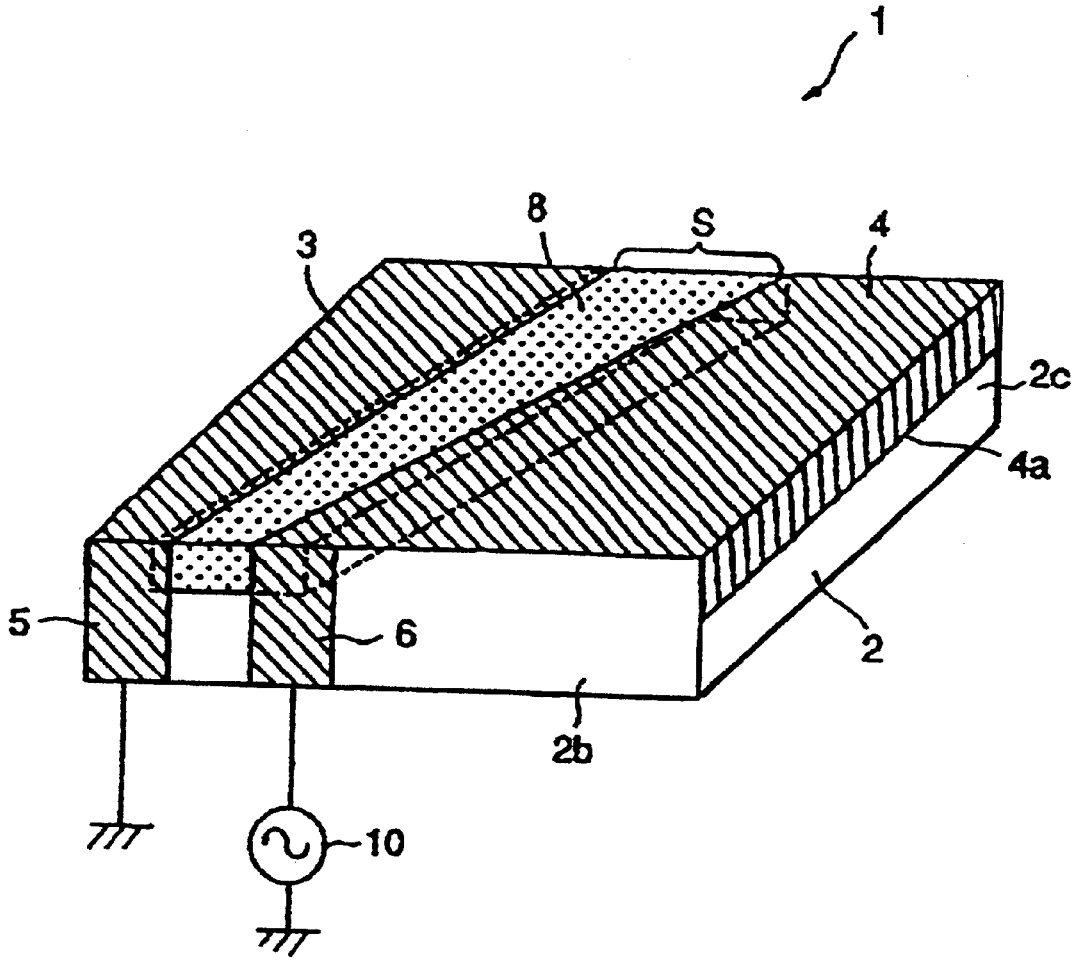
FIG. 9 is an another explanatory view showing still another embodiment of the present invention.
Figure 10:
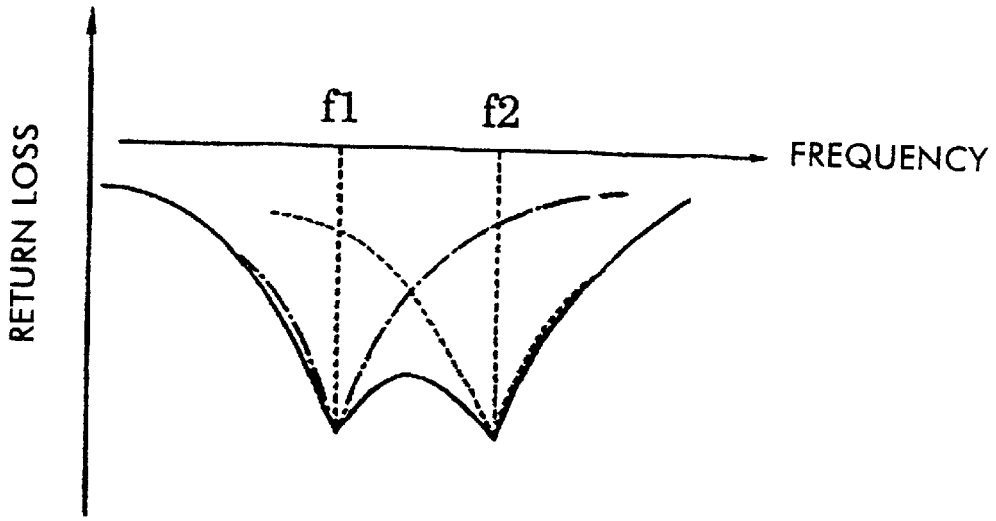
FIG. 10 is a diagram showing an example of frequency characteristics of a plural-resonance surface-mounted type antenna.

In the above-described first embodiment, the width of the permittivity adjusting material portion 8 is narrower than that of the space S between the power non-supplied side radiation electrode 3 and the power supplied side radiation electrode 4. However, as shown in FIG. 9, the width of permittivity adjusting material portion 8 may be arranged so as to be wider than that of the space S so that the power non-supplied side radiation electrode 3 and the power supplied side radiation electrode 4 are formed astride the edge portions of the permittivity adjusting material portion 8.

In the above-described second embodiment, the groove 12 is provided in the space S between the power non-supplied side radiation electrode 3 and the power supplied side radiation electrode 4, but, for example, a recess without an opening may be formed on the side surfaces 2*b* and 2*d*, instead of the groove 12. Furthermore, a plurality of recesses as capacitive-coupling adjusting means may be arranged with a space therebetween.

In the above-described third embodiment, the two hollow portions 14 and 15 are provided, but only one of these hollow portions 14 and 15 may be formed. Also, the shape of the hollow portions 14 and 15 is not limited to the one shown in FIG. 3, but various shapes may be adopted. For example, the hollow portions 14 and 15 shown in FIG. 3 pass through the dielectric substrate from the side surface 2*b* to the side surface 2*d*, but they may be closed hollow portions without openings. Furthermore, the hollow portions 14 and 15 may be recesses or groove-shaped hollow portions such that the bottom 2*f* side of the dielectric substrate 2 is open.

Among the construction wherein a permittivity adjusting material portion is provided as shown in the first embodiment, the construction wherein a groove or a recess is provided as shown in the second embodiment, the construction wherein hollow portions are provided as shown in the third embodiment, and the construction wherein the dielectric substrate 2 constitutes a bonded body of a plurality of dielectric substrates which differ in the permittivity from each other as shown in the fourth embodiment, two or more constructions may be combined to use.

Furthermore, in the above-described fifth embodiment, although the one example of a portable telephone as a communication device is shown, this invention is not restricted to portable telephones, but can be applied to communication devices other than portable telephones.

In the above-described embodiments, descriptions have been made of the construction for weakening the capacitive coupling between the power non-supplied side radiation electrode 3 and the power supplied side radiation electrode 4. However, when the capacity between the power non-supplied side radiation electrode 3 and the power supplied side radiation electrode 4 is significantly smaller than the above-described fringing capacity, it is preferable to increase the capacity between the power non-supplied side radiation electrode 3 and the power supplied side radiation electrode 4 so as to be commensurate with the fringing capacity, and to thereby strengthen the capacitive coupling between the power non-supplied side radiation electrode 3 and the power supplied side radiation electrode 4.

In such a case, there is provided capacitive-coupling adjusting means for strengthening the capacitive coupling between the power non-supplied side radiation electrode 3 and the power supplied side radiation electrode 4. For example, as indicated by the dot lines in FIG. 7(*a*) and as illustrated in FIG. 9, the following permittivity adjusting material portion 8 as capacitive-coupling adjusting means is provided in the space S between the power non-supplied side radiation electrode 3 and the power supplied side radiation electrode 4. This permittivity adjusting material portion 8 is formed of a material having a higher permittivity than that of the dielectric substrate 2. It is, therefore, possible to make the permittivity between the power non-supplied side radiation electrode 3 and the power supplied side radiation electrode 4 larger than that of the dielectric substrate 2, and to thereby adjust the capacity between the power non-supplied side radiation electrode 3 and the power supplied side radiation electrode 4 to become a capacity which is commensurate with that of the above-described fringing capacity. Meanwhile, in the case where the power non-supplied side radiation electrode 3 and the power supplied side radiation electrode 4 have shapes as shown in FIG. 9, it is preferable that each of the power non-supplied side radiation electrode 3 and the power supplied side radiation electrode 4 be disposed astride the side edges of the permittivity adjusting material portion 8.

Figure 11:
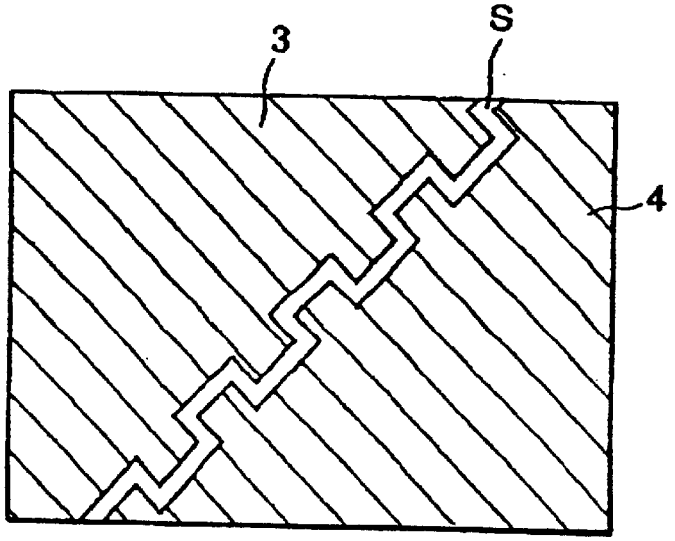
FIG. 11 is an explanatory view showing a construction for strengthen the capacity between the power supplied side radiation electrode and the power non-supplied side radiation electrode in accordance with the present invention.

Also, the power non-supplied side radiation electrode 3 and the power supplied side radiation electrode 4 may be formed into shapes as shown in FIG. 11 so that the space S between the power non-supplied side radiation electrode 3 and the power supplied side radiation electrode 4 is narrowed, and that the capacity between the power non-supplied side radiation electrode 3 and the power supplied side radiation electrode 4 is increased so as to become a capacity which is commensurate with that of the above-described fringing capacity, by enlarging the areas of the opposing electrodes.

As described above, when satisfactory plural resonance conditions cannot be achieved because the capacity between the power non-supplied side radiation electrode 3 and the power supplied side radiation electrode 4 is significantly smaller than the fringing capacity, the capacity between the power non-supplied side radiation electrode 3 and the power supplied side radiation electrode 4 and the fringing capacity can be brought into a proper matching relation, by adjusting the capacity between the power non-supplied side radiation electrode 3 and the power supplied side radiation electrode 4 to increase so as to become a capacity which is commensurate with the fringing capacity by means of the above-described capacitive-coupling adjusting means for increasing the capacity between the power non-supplied side radiation electrode 3 and the power supplied side radiation electrode 4. Hence, it is possible to suppress the mutual interference of the resonances between the power non-supplied side radiation electrode 3 and the power supplied side radiation electrode 4, which results in superior plural-resonance conditions.

Also, the power non-supplied side radiation electrode 3 and the power supplied side radiation electrode 4 may be formed within the dielectric substrate 2. In this case, as the dielectric substrate 2, a multilayer substrate formed by laminating a plurality of ceramic green sheets may be used. Ceramic green sheets having a different permittivity from that of the above-mentioned ceramic sheets may be provided between the power non-supplied side radiation electrode 3 and the power supplied side radiation electrode 4, for use as capacitive- coupling adjusting means.

As described above, in accordance with the present invention, when capacitive-coupling adjusting means is provided, and the strength of the capacitive coupling between the first radiation electrode and the second radiation electrode is varied by making the permittivity in the space which is situated between the first radiation electrode and the second radiation electrode and in which a capacity occurs, differ from that of the dielectric substrate by means of the above-described capacitive-coupling adjusting means, the mutual interference of the resonances between the first radiation electrode and the second radiation electrode can be inhibited. It is, therefore, possible to stably achieve superior plural-resonance conditions without taking measures such as a reduction of the permittivity of the dielectric substrate or widening of the space S between the first radiation electrode and the second radiation electrode, the measures inhibiting the miniaturization of the dielectric substrate. In addition, from the viewpoint of thinning, it becomes easy to attain a capacity between the first radiation electrode and the second radiation electrode which is commensurate with each of the capacities between the above-mentioned two electrodes and the ground, which allows the degree of freedom of design to be improved.

Since superior plural-resonance conditions are thus stably achieved, a surface-mounted type antenna which is small and low-profile and which has high-reliability antenna characteristics can be provided.

When a recess or a groove which is capacitive-coupling adjusting means is formed, when a permittivity adjusting material portion which is capacitive-coupling adjusting means is formed, or when hollow portions which are capacitive- coupling adjusting means are formed, the strength of the capacitive coupling between the first radiation electrode and the second radiation electrode can be varied by a simple construction, whereby superior effects as described above are produced.

When the dielectric substrate constitutes a bonded body of the first dielectric substrate and the second dielectric substrate which differ in the permittivity from each other, the first radiation electrode is formed on the first dielectric substrate while the second radiation electrode is formed on the second dielectric substrate, and a bonded portion between the first dielectric substrate and the second dielectric substrate is provided between the first radiation electrode and the second radiation electrode, it is possible to vary the permittivity between the first radiation electrode and the second radiation electrode, as in the case described above. This allows the mutual interference of the resonances between the first radiation electrode and the second radiation electrode to be suppressed, and enables a surface-mounted type antenna which is small and low-profile and which has high-reliability antenna characteristics to be provided. In addition, the degree of freedom of design can be improved.

In a communication device which is provided with the surface-mounted type antenna which produces above-described effects, it is possible to easily promote the miniaturization of the communication device as a result of the size-reduction of the surface-mounted type antenna, and also possible to improve the reliability of communication.

INDUSTRIAL APPLICABILITY

As is evident from the above descriptions, the surface-mounted type antenna and the communication device provided therewith are applied to, for example, surface-mounted type antennas and the like to be mounted on the circuit boards incorporated in communication devices such as portable telephones.

What is claimed is:

1. A surface-mounted type antenna comprising:

a dielectric substrate;

a first radiation electrode formed on said dielectric substrate; and a second radiation electrode disposed on said dielectric substrate at a predetermined distance from said first radiation electrode, the first and second radiation electrodes each having respective lengths adjacent each other, further wherein:

capacitive-coupling adjusting means is provided which make the permittivity between said first radiation electrode and said second radiation electrode differ from that of said dielectric substrate, and which varies the strength of the capacitive coupling between said first radiation electrode and said second radiation electrode, said capacitive-coupling adjusting means comprising a permittivity adjusting portion which causes the capacitive coupling between the first and second radiation electrodes to vary over the adjacent lengths of the first and second radiation electrodes.

2. The surface-mounted type antenna as claimed in claim 1, wherein:

said first radiation electrode and said second radiation electrode are formed on a surface of said dielectric substrate.

3. The surface-mounted type antenna as claimed in claim 1, wherein:

said capacitive-coupling adjusting means comprises a recess or a groove formed between said first radiation electrode and said second radiation electrode, in the surface of the dielectric substrate.

4. The surface-mounted type antenna as claimed in claim 1, wherein:

the permittivity adjusting portion comprises a permittivity adjusting material portion which has a different permittivity from that of the dielectric substrate and is interposed between said first radiation electrode and said second radiation electrode.

5. The surface-mounted type antenna as claimed in claim 1, wherein:

said capacitive-coupling adjusting means comprises an area between said first radiation electrode and said second radiation electrode, said area being a hollow portion situated inside said dielectric substrate.

6. The surface-mounted type antenna as claimed in claim 1, wherein:

said first radiation electrode and said second radiation electrode are formed so that the resonance directions thereof are substantially orthogonal to each other.

7. A surface-mounted type antenna comprising:

a dielectric substrate;

a first radiation electrode formed on a surface of said dielectric substrate; and a second radiation electrode disposed on the surface of said dielectric substrate at a predetermined distance from said first radiation electrode, wherein:

said dielectric substrate is formed by bonding a first dielectric substrate and a second dielectric substrate which has a different permittivity from that of said first dielectric substrate, a bonded portion being formed where the first and second dielectric substrates are bonded together;

said first radiation electrode is formed on said first dielectric substrate, and said second radiation electrode is formed on said second dielectric substrate; and the bonded portion between said first dielectric substrate and said second dielectric substrate is disposed between the first radiation electrode and the second radiation electrode.

8. The surface-mounted type antenna as claimed in claim 7, wherein:

said first radiation electrode and said second radiation electrode are formed so that the resonance directions thereof are substantially orthogonal to each other.

9. A communication device comprising:

at least one of a transmitting circuit and a receiving circuit, a surface-mounted type antenna mounted on a circuit board, the surface-mounted type antenna comprising:

a dielectric substrate;

a first radiation electrode formed on said dielectric substrate; and a second radiation electrode disposed on said dielectric substrate at a predetermined distance from said first radiation electrode, the first and second radiation electrodes each having respective lengths adjacent each other, further wherein:

capacitive-coupling adjusting means is provided which make the permittivity between said first radiation electrode and said second radiation electrode differ from that of said dielectric substrate, and which varies the strength of the capacitive coupling between said first radiation electrode and said second radiation electrode, said capacitive-coupling adjusting means comprising a permittivity adjusting portion which causes the capacitive coupling between the first and second radiation electrodes to vary over the adjacent lengths of the first and second radiation electrodes.

10. The communication device as claimed in claim 9, wherein:

said first radiation electrode and said second radiation electrode are formed on a surface of said dielectric substrate.

11. The communication device as claimed in claim 9, wherein:

said capacitive-coupling adjusting means comprises a recess or a groove formed between said first radiation electrode and said second radiation electrode, in the surface of the dielectric substrate.

12. The communication device as claimed in claim 9, wherein:

the permittivity adjusting portion comprises a permittivity adjusting material portion which has a different permittivity from that of the dielectric substrate and is interposed between said first radiation electrode and said second radiation electrode.

13. The communication device as claimed in claim 9, wherein:

said capacitive-coupling adjusting means comprises an area between said first radiation electrode and said second radiation electrode, said area being a hollow portion situated inside said dielectric substrate.

14. The communication device as claimed in claim 9, wherein:

said first radiation electrode and said second radiation electrode are formed so that the resonance directions thereof are substantially orthogonal to each other.

15. A communication device comprising:

at least one of a transmitter circuit and a receiving circuit;

a surface-mounted type antenna mounted on a circuit board, the surface-mounted type antenna comprising:

a dielectric substrate;

a first radiation electrode formed on a surface of said dielectric substrate; and a second radiation electrode disposed on the surface of said dielectric substrate at a predetermined distance from said first radiation electrode, wherein:

said dielectric substrate is formed by bonding a first dielectric substrate and a second dielectric substrate which has a different permittivity from that of said first dielectric substrate, a bonded portion being formed where the first and second dielectric substrates are bonded together;

said first radiation electrode is formed on said first dielectric substrate, and said second radiation electrode is formed on said second dielectric substrate; and the bonded portion between said first dielectric substrate and said second dielectric substrate is disposed between the first radiation electrode and the second radiation electrode.

16. The communication device as claimed in claim 15, wherein:

said first radiation electrode and said second radiation electrode are formed so that the resonance directions thereof are substantially orthogonal to each other.

17. A surface-mounted type antenna comprising:

a dielectric substrate;

a first radiation electrode formed on said dielectric substrate; and a second radiation electrode disposed on said dielectric substrate at a predetermined distance from said first radiation electrode, the first and second radiation electrodes each having respective lengths adjacent each other, further wherein:

a capacitive-coupling adjusting portion is provided which make the permittivity between said first radiation electrode and said second radiation electrode differ from that of said dielectric substrate, and which varies the strength of the capacitive coupling between said first radiation electrode and said second radiation electrode, said capacitive-coupling adjusting portion comprising a permittivity adjusting portion which causes the capacitive coupling between the first and second radiation electrodes to vary over the adjacent lengths of the first and second radiation electrodes.

18. The surface-mounted type antenna as claimed in claim 17, wherein the width of said capacitive coupling adjusting portion varies over the lengths of the first and second radiation electrodes.

* * * * *